US005661272A

United States Patent [19]

Iannetti

[11] Patent Number: 5,661,272

[45] Date of Patent: Aug. 26, 1997

[54] ENGINE NOISE REDUCTION APPARATUS

[76] Inventor: Francesco E. Iannetti, 4913 Oak Park Rd., Raleigh, N.C. 27612

[21] Appl. No.: 379,733

[22] Filed: Jan. 27, 1995

[51] Int. Cl.[6] ..... F01N 1/24

[52] U.S. Cl. ..... 181/256; 181/252; 181/267; 181/276; 181/258

[58] Field of Search ..... 181/267, 276, 181/268, 275, 250, 252, 256, 227, 228, 282, 258, 224

[56] References Cited

U.S. PATENT DOCUMENTS

| | | | |
|---|---|---|---|
| 582,485 | 5/1897 | Reeves . | |
| 712,791 | 11/1902 | Hedstrom . | |
| 1,128,306 | 2/1915 | Goelzer . | |
| 1,685,701 | 9/1928 | Blanchard . | |
| 1,844,105 | 2/1932 | Schnell | 181/252 |
| 1,861,775 | 6/1932 | Aseltine . | |
| 1,876,861 | 9/1932 | Compo . | |
| 2,036,138 | 3/1936 | Haas . | |
| 2,716,463 | 8/1955 | Latulippe . | |
| 3,154,388 | 10/1964 | Purse . | |
| 3,738,448 | 6/1973 | Vér et al. | 181/267 |
| 3,776,365 | 12/1973 | Richards | 181/267 |
| 3,786,791 | 1/1974 | Richardson . | |
| 4,076,099 | 2/1978 | Proksch . | |
| 4,167,986 | 9/1979 | Conway | 181/224 |
| 4,595,073 | 6/1986 | Thawani . | |
| 5,196,653 | 3/1993 | Kiss . | |
| 5,350,888 | 9/1994 | Sager, Jr. et al. . | |

OTHER PUBLICATIONS

A 3M Brochure on Nextel™ Ceramic Fiber Filters for diesel emission control.

*Primary Examiner*—Khanh Dang

[57] ABSTRACT

The present invention is a noise reduction apparatus for use in the exhaust system of an internal combustion engine which absorbs acoustical energy from the pressurized exhaust gases while minimizing restrictions on the exhaust gases as they flow therethrough. The relatively unrestricted exhaust gas flow provided by the present invention significantly reduces the build up of back pressure and the associated drop in power and performance of the engine. At the same time, by absorbing acoustical energy from the exhaust gases, the noise level of the exhaust system is reduced. The present noise reduction apparatus includes a housing operatively adapted for being disposed in the exhaust system of an internal combustion engine, and a plurality of generally concentric and radially spaced tubular sections disposed inside of the housing. Each tubular section is adapted with a porous wall which allows exhaust gases to flow therethrough. A plurality of sound absorbing layers are also disposed inside the housing. Each layer is operatively adapted to allow exhaust gases to flow therethrough while absorbing acoustical energy from exhaust gases coming in contact with the layer. Each layer is also operatively associated with one tubular section to allow exhaust gases to flow through the housing, from one end to the other, without having to flow through one of the sound absorbing layers.

16 Claims, 1 Drawing Sheet

ENGINE NOISE REDUCTION APPARATUS

FIELD OF THE INVENTION

The present invention is related to-noise reduction devices for the exhaust of an internal combustion engine, more particularly to a muffler which reduces the noise level of the exhaust while having little if any detrimental affect on the power output of the engine, and even more particularly to such a muffler for an automotive vehicle.

BACKGROUND OF THE INVENTION

Internal combustion engines typically force pressurized exhaust gases through some form of an exhaust system which pipes the exhaust gases out into the atmosphere. When engine exhaust gases are forced out into the atmosphere under high pressure (i.e., with high energy) through an opening, a high decibel sound or noise is generated as the exhaust gases are expelled. Exhaust systems have been developed with various forms of noise reduction devices (i.e., mufflers) in an effort to reduce the noise levels caused by the exiting exhaust gases. Such exhaust systems are designed so that the exhaust gases flow through one or more mufflers before they exit into the atmosphere.

In general, mufflers reduce the exhaust noise levels by restricting the flow of exhaust gases through the muffler, causing the gases to exit to atmosphere at slower rates (i.e., under less pressure). As the flow of exhaust gases is restricted, a back pressure builds up in the exhaust system. Unfortunately, as the back pressure increases, the power output (horse power) and overall performance of the engine typically suffers. Therefore, in order to maintain engine exhaust noise at tolerable levels, the engine's optimum performance level is usually sacrificed.

The performance and power output requirements for some uses of combustion engines, such as in street vehicles, are less than that required for other applications, such as in high performance race cars. With regard to exhaust noise levels, regulations governing conventional street driven vehicles typically mandate lower noise limits than the limits allowed in race car driving and other such applications, where engine performance and horse power are of primary importance. Consequently, the muffler of a standard street vehicle is designed to reduce noise levels and allows higher exhaust back pressures to build up. In contrast, the muffler of a high performance racing engine, which requires higher performance and greater horse power than a standard street car, is designed to allow higher noise levels to be reached in order to reduce back pressures.

While comparatively high noise levels are considered less of a nuisance in applications like race car driving, there are still limits to the level of engine noise allowed during, for example, an IMSA grand prix auto race. Even mufflers designed to satisfy these more tolerant noise level requirements cause back pressures to develop which can significantly impact the performance of an engine and its horse power. Thus, regardless of how the internal combustion engine is used (e.g. in a street car, race car, lawn mower, etc.), there is a continuing need for a muffler capable of lowering exhaust noise levels without a significant detrimental affect on engine performance and power output.

SUMMARY OF THE INVENTION

This need is satisfied by providing a noise reduction apparatus for use in the exhaust system of an internal combustion engine according to the principles of the present invention. The present noise reduction apparatus absorbs acoustical energy from the pressurized exhaust gases while minimizing restrictions on the exhaust gases as they flow through the present noise reduction apparatus to atmosphere. The relatively unrestricted exhaust gas flow provided by the present invention reduces the build up of back pressure and the associated drop in power and performance of the engine. At the same time, by absorbing acoustical energy from the exhaust gases the noise level of the exhaust system is reduced.

In one aspect of the present invention, a noise reduction apparatus is provided which includes a plurality of sound (i.e., acoustical energy) absorbing layers disposed inside a housing. The housing has an upstream end and a downstream end and is operatively adapted for being disposed in the exhaust system of an internal combustion engine. A plurality of generally concentric and radially spaced tubular sections may also be disposed inside the housing. Each sound absorbing layer can be structurally supported by at least one of the tubular sections. Each of the tubular sections has an upstream end and a downstream end and is operatively adapted with a porous wall that allows exhaust gases to flow therethrough. Each of the sound absorbing layers is made of an acoustical energy absorbing material, and is operatively adapted to allow exhaust gases to flow therethrough. In addition, each sound absorbing layer is operatively associated with one tubular section so as to allow exhaust gases to flow through the housing, from one end to the other without having to flow through one of the sound absorbing layers. Futhermore the present noise reduction apparatus can also be operatively adapted to allow exhaust gases to flow along its central longitudinal axis relatively unrestricted, from one end of the noise reduction apparatus to the other, such as by not having to flow through a porous wall.

Preferably, each sound absorbing layer is also operatively adapted to maximize the surface area of the material forming the layer so that the acoustical energy absorbed from exhaust gases which come in contact with the layer are maximized. In addition, it is preferable for each layer to be operatively associated with one tubular section so as to allow exhaust gases to flow relatively unrestricted from one end to the other of said one tubular section. This relatively unrestricted gas flow can be obtained by forming a pathway that runs lengthwise along and between any two radially adjacent tubular sections.

Each tubular section can be sheathed or otherwise surrounded by its associated sound absorbing layer. Alternatively. a sound absorbing layer can line the inside surface of or otherwise be disposed inside of each tubular section. A suitable polymeric, metallic or ceramic material or combinations thereof may be used to construct each sound absorbing layer. The material used to make each sound absorbing layer is preferably in fiber or fabric form but may also be in a particle form, cast form or any suitable combination of two or more of a particle, fiber and fabric form.

There are many ways of structurally maintaining the relative spacing between the tubular sections. Some type of a mechanical spacer can be used. A plurality of spacers can be disposed between the tubular sections, at various locations along its length, a spacer can be disposed adjacent the upstream end and the downstream end of the tubular sections, or a combination of both can be used. By way of example only, the spacers can be in the form of a porous wall, which allows exhaust gases to flow therethrough, mounting one end of the tubular sections and a bracket with cross bars mounting the other end of the tubular section. The porous wall or the cross bracket could also be used exclusively at both ends of the tubular section. A cross bracket is less likely to restrict the flow of exhaust gases than the use of a porous wall. However, a porous wall may provide a greater degree of structural integrity, depending on the configuration of the porous wall.

It may be desirable for the spacer to be a truncated cone-shaped element disposed inside the housing so as to taper toward the downstream end of the housing. The truncated cone-shaped element is adapted with a porous wall which allows exhaust gases to flow therethrough. Even though it is porous, the truncated cone-shaped element still tends to compress the gas flow, which helps to reduce the noise level. The truncated cone-shaped element also has an open funnel end disposed upstream in the housing and preferably an open tapered end disposed downstream in the housing. The cone shape causes the flow of the exhaust gases to gradually transition into the pathways between the tubular sections, resulting in improved gas flow and less turbulence (i.e., lower back pressure). The truncated cone-shaped element is disposed within each of the tubular sections, with the upstream end of each tubular section being joined to the wall of the truncated cone-shaped element. Alternatively, the upstream end, of each tubular section can be disposed further downstream of the truncated cone-shaped element. Being open at both ends, the truncated cone-shaped element allows exhaust gases to flow along its central longitudinal axis and through the present noise reduction apparatus relatively unrestricted, such as by not having to flow through a porous wall.

In addition to the advantages discussed above, the principles of the present invention enable a compact and light weight noise reduction apparatus to be made while maintaining satisfactory noise reduction and engine performance characteristics. Furthermore, the sound absorbing layers help in thermally insulating the noise reduction apparatus and reducing the outer temperature of the housing.

The objectives, features, and advantages of the present invention are apparent from the description disclosed herein and the appended drawings and claims.

DETAILED DESCRIPTION OF THE INVENTION

Although the present invention is herein described in terms of a specific embodiment, it will be readily apparent to those skilled in this art that various modifications, rearrangements, and substitutions can be made without departing from the spirit of the invention. The scope of the present invention is thus only limited by the claims appended hereto.

Figure 1:
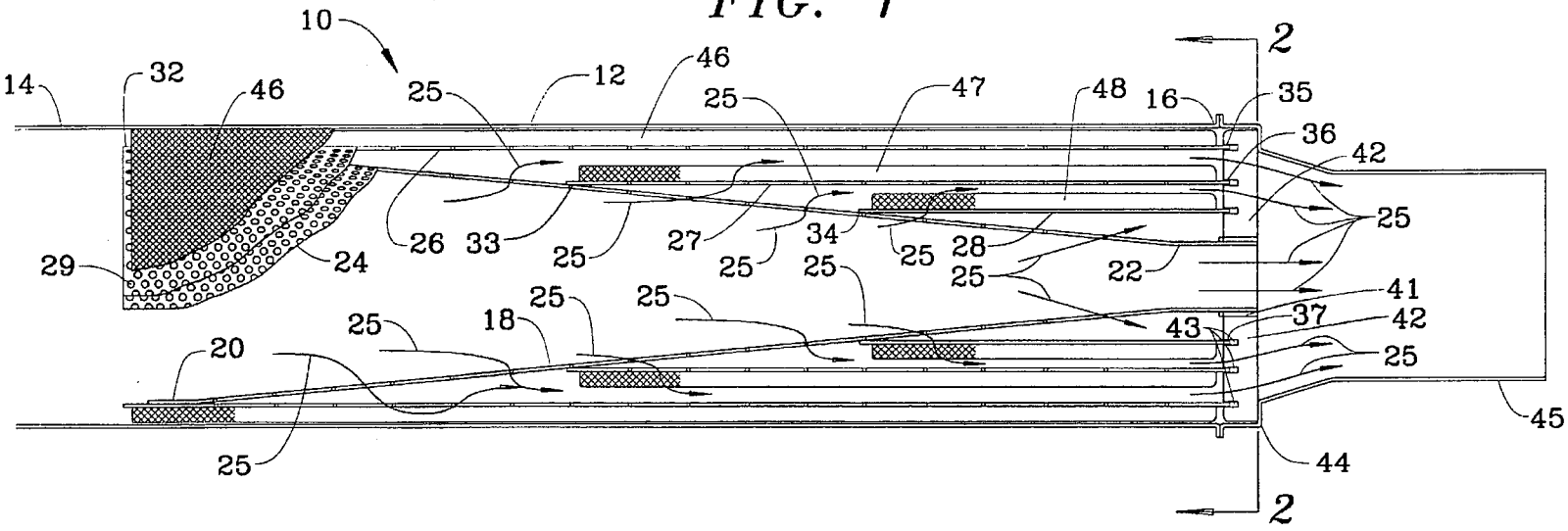
FIG. 1 is a partially broken away and sectional side view of one embodiment of the present noise reduction apparatus.
Figure 2:
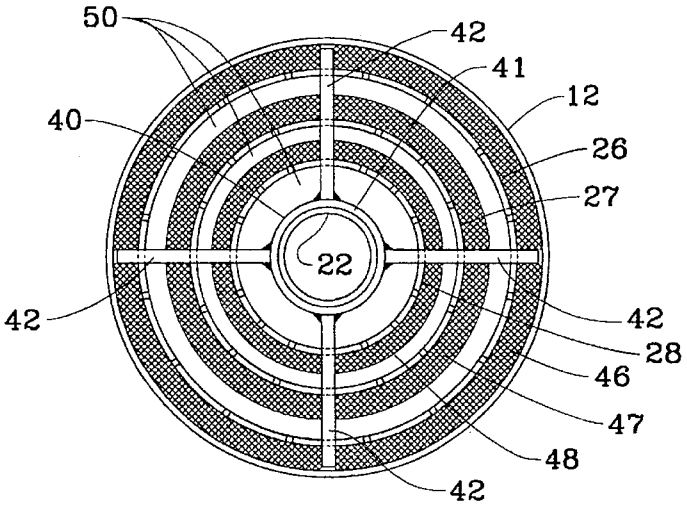
FIG. 2 is an end view of the noise reduction apparatus of FIG. 1 taken along lines 2—2.

Referring to FIGS. 1 and 2, one embodiment of a noise reduction apparatus 10 according to the principles of the present invention is used in the exhaust system (not shown) of an internal combustion engine (not shown). The noise reduction apparatus 10 absorbs acoustical energy from pressurized exhaust gases produced by the engine while minimizing restrictions on the exhaust gases as they flow through the noise reduction apparatus 10 to atmosphere. By absorbing acoustical energy from the exhaust gases, the noise level of the exhaust system is reduced. At the same time, the relatively unrestricted exhaust gas flow provided by the noise reduction apparatus 10 reduces the build up-of back pressure and the associated drop in power and performance of the engine.

The exemplary noise reduction apparatus 10 includes a tubular housing 12 having an upstream end 14 and a downstream end 16 operatively adapted for being disposed in an exhaust system (not shown) of an internal combustion engine (not shown). Methods for disposing noise reduction devices in an engine exhaust system are well known. The method for so disposing the noise reduction apparatus forms no basis for the present invention and will therefore not be discussed in detail herein. A suitable housing 12 can be made from Inconel 625 sheet metal, having a wall thickness of about 0.40 inches.

A truncated cone-shaped element 18 is disposed inside the housing 12. The cone 18 has an open funnel end 20 disposed adjacent the upstream end 14 of the housing 12 and preferably an open tapered end 22 disposed adjacent the downstream end 16 of the housing 12. The truncated cone-shaped element 18 is adapted with a substantially perforated wall 24 to allow exhaust gases, as depicted by arrows 25, to flow therethrough. Preferably, the wall 24 has as high a degree of perforation as possible, without critically affecting its structural integrity. The degree of perforation is defined as the area of perforations per unit surface area of wall. A suitable truncated cone-shaped element 18 can be made out of Inconel 625 sheet metal having a wall thickness of about 0.032 inches and approximately 48% of its surface area perforated with about 3/16 inch diameter holes separated from each other on their centers by about ¼ inch. Instead of being open, as shown, it is believed that satisfactory results can be obtained if the open tapered end 22 of truncated cone-shaped element 18 is enclosed by the perforated wall 24.

At least one and preferably a plurality of generally concentric and radially spaced tubes are disposed inside the housing 12 and outside the truncated cone-shaped element 18. In the exemplary embodiment, a first tube 26, second tube 27 and third tube 28 are shown. As with the truncated cone-shaped element 18, each of the tubes 26–28 is adapted with a substantially perforated wall to allow exhaust gases 25 to flow therethrough. The wall of tube 26 (designated with the reference number 29) is shown in a partially broken away view. The walls of the other tubes 27 and 28 are similarly perforated. Preferably, the walls of the tubes 26–28 each have as high a degree of perforation as possible, without critically affecting their structural integrity. Suitable tubes 26–28 can be made out of the same Inconel 625 sheet metal as that used to make the truncated cone-shaped element 18, including having a wall thickness of about 0.032 inches and approximately 48% of its surface area perforated with about 3/16 inch diameter holes separated from each other on their centers by about ¼ inch. The third tube 28 has a smaller diameter than the second tube 27 and is disposed concentrically within the second tube 27. Similarly, the second tube 27 has a smaller diameter than and is disposed concentrically within the first tube 26. Each of the tubes 26, 27 and 28 has an upstream end 32, 33 and 34 and a downstream end 35, 36 and 37, respectively. The upstream ends 3234 are longitudinally staggered relative to one another, and the downstream ends 35–37 are, in general, longitudinally even with one another. The cone 18 is disposed within each of the tubes 26–28.

The upstream ends 32–34 of the tubes 26–28 can be joined by any suitable means (e.g., by welding, brazing, mechanical fastener, etc.) to the wall 24 of the truncated cone-shaped element 18. In this way, the truncated cone-shaped element 18 functions as a spacer to maintain the upstream ends 32–34 of the tubes 26–28 in their radially spaced apart relationship. The downstream ends of the housing 12, truncated cone-shaped element 18 and tubes 26–28 are kept in a radially spaced apart relation by a different form of a spacer, such as a cross bracket 40. Bracket 40 can be of any suitable configuration which sufficiently maintains the radial relationship between the downstream ends of the housing 12, truncated cone-shaped element 18 and tubes 26–28 while only slightly restricting the flow of exhaust gases out of the apparatus 10, if at all. Bracket 40 has a tubular hub 41 with four cross bars 42 extending radially out therefrom. The downstream tapered end 22 of truncated cone-shaped element 18 is disposed inside hub 41. The downstream end of each tube 26–28 is received in a spacer notch 43 formed in each cross bar 42. Each cross bar 42 has a total of three spacer notches 43, one for each tube 26–28.

Bracket 40 may be integrally fixed in place by any suitable means, such as welding, brazing, etc. Preferably, only one end of each tube 26–28 is integrally fixed in place, to allow for thermal expansion. To accomplish this, bracket 40 may be kept in place by an end cap 44 fixed to the downstream end 16 of housing 12. End cap 44 could also be used to keep the tubes 26–28 in position without their upstream ends 32–34 having to be joined to the cone wall 24. End cap 44 may include a tailpipe section 45 for directing the exhaust gases 25 out to atmosphere. It is preferable for apparatus 10 to be used without an end cap 44 and tailpipe section 45, because these elements tend to restrict the flow of exhaust gases 25 through apparatus 10.

It is believed that satisfactory results can be obtained if the truncated cone-shaped element 18 is replaced with another spacer (not shown) similar to bracket 40 for maintaining the radial spacing of the upstream ends 32–34 of the tubes 26–28. To use two brackets 40, one at either end all the tubes 26–28 should be the same length and longitudinally in line with each other. Even without the truncated cone-shaped element 18, the longitudinally staggered relation of the upstream ends 32–34 can be maintained by using a separate spacer (not shown) for each upstream end 32–34. The separate spacers (not shown) could be similar to bracket 40, but with increasingly larger hubs (going in the upstream direction to approximate the shape of the tapered wall 24 of truncated cone-shaped element 18. Accordingly, the upstream and downstream ends of tubes 26–28 can be longitudinally staggered or even with one another.

There are also a plurality of sound absorbing layers 46, 47 and 48, one associated with each tube 26, 27 and 28, respectively. It has been found desirable to sheath or otherwise surround each tube 26–28 with its associated sound absorbing layer 46–48. Alternatively, the inside surface of each tube 26–28 can be lined or otherwise disposed with its associated sound absorbing layer 46–48. Each sound absorbing layer 46"48 is made of a suitable acoustical energy absorbing polymeric, metallic or ceramic material or combinations thereof. The material used to make each sound absorbing layer 46–48 is preferably in fiber or fabric form, but each layer 46–48 can also be in particle form. The fibers or particles used could be of any suitable size or shape. For example, the fibers could be short needles or long threads.

Satisfactory sound absorbing layers have been formed by wrapping multiple layers of a ceramic fiber, Nextel 312, manufactured by 3M, St. Paul, Minn., around the outside of each tube 26–28 in a criss-crossing pattern. Each layer 46–48 should be wrapped with enough fiber to provide the surface area needed to optimize the acoustical energy absorbtion. At the same time, the fibers in each layer 46–48 should be sufficiently spaced to provide the degree of porosity needed to allow the exhaust gases to flow therethrough without too much back pressure being generated. The optimum amount of acoustical energy absorbing surface area and degree of porosity for the layers used can vary depending on the particular application in which the noise reduction apparatus of the present invention is used. For example, in general, it would likely be more acceptible to allow a higher noise level but less back pressure (i.e., reducing the amount of surface area and increasing the degree of porosity in the layer) in a race car application than in a street car application. It is understood that the appearance of the layers 46–48 in cross section, as partially shown in both FIGS. 1 and 2, is not how the layers 46–48 appear in true cross section.

If short fibers or small particles are used, they will likely need to be maintained in position and prevented from moving about within the housing 12 in order to prevent the loss of the noise absorbing material and the clogging, of the holes formed through the walls of the truncated cone-shaped element 18 and tubes 26–28. For example the short fibers or particles could be sintered or otherwise bonded together or encapsulated in some way, such as with a screen. Furthermore, with time, portions of the layers 46–48 made from long fibers or fabric may fracture off. Therefore, it may also be desirable to somehow bond together or encase sound absorbing layers 46–48 formed using wound fibers or fabric to prevent fractured portions from moving about within the housing. In addition, it may be desirable to make each sound absorbing layer out of any suitable combination of one or more of these forms (i.e., particle, fiber and fabric). The material and form used for the sound absorbing layers 46–48 will likely be dependant upon how and where the noise reduction apparatus 10 is being used. For example, higher performance and likely more expensive materials, such as high temperature, high strength and high toughness materials, may be necessary in high performance race cars or other applications which subject the apparatus to very severe working conditions.

Thus, each of the sound absorbing layers 46–48 is operatively adapted to allow exhaust gases to flow therethrough and to absorb acoustical energy from exhaust gases flowing therethrough or otherwise coming in contact with the layer. In addition, each layer is operatively associated with one tube so as to allow exhaust gases to flow relatively unrestricted from one end to the other of the one tube. This relatively unrestricted flow of exhaust gases can be accomplished by adapting each sound absorbing layer 46–48 and spacing apart the tubes 26–28 so that a pathway 50 is formed that runs lengthwise from one end to the other along and between any two radially adjacent tubes as well as between the truncated cone-shaped element 18 and the innermost tube 28. The apparatus 10 can also be operatively adapted to allow exhaust gases to flow along its central longitudinal axis relatively unrestricted, from one end of said apparatus 10 to the other, such as by not having to flow through a porous wall.

From the above disclosure of the general principles of the present invention and the preceding detailed description, those skilled in this art will readily comprehend the various modifications to which the present invention is susceptible. Therefore, the scope of the invention should be limited only by the following claims and equivalents thereof.

What is claimed is:

1. A noise reduction apparatus for reducing the sound level of exhaust gases passing therethrough from an internal combustion engine having an exhaust system, said apparatus comprising:

a housing operatively adapted for being mounted within the exhaust system of an internal combustion engine so that exhaust gases can pass through said apparatus, said housing having an upstream end through which exhaust gases enter said apparatus and a downstream end through which exhaust gases exit said apparatus;

a plurality of tubular sound absorbing layers radially spaced apart relative to one another, each of said plurality of sound absorbing layers having an upstream end, being sufficiently porous to allow exhaust gases to flow therethrough and being operatively adapted to absorb acoustical energy from exhaust gases coming in contact therewith, said sound absorbing layers being mounted inside of said housing such that the upstream ends of said sound absorbing layers are longitudinally staggered relative to one another so as to generally define a truncated cone shape.

2. The apparatus of claim 1, further comprising a plurality of tubular sections mounted inside of said housing, each of said tubular sections having a porous wall, each of said sound absorbing layers being supported by at least one of said tubular sections, and said apparatus being operatively adapted to allow exhaust gases to flow therethrough, from one end to the other, without having to flow through the porous wall of one of said tubular sections.

3. The apparatus of claim 1, further comprising a plurality of tubular sections mounted inside of said housing, each of said plurality of tubular sections having a porous wall operatively adapted for allowing exhaust gases to flow therethrough, and each of said tubular sections being sheathed by at least one of said sound absorbing layers.

4. The apparatus of claim 1, each of said sound absorbing layers being made of an acoustical energy absorbing material in a form selected from the group consisting of acoustical energy absorbing particles, fiber, fabric and combinations thereof.

5. The apparatus of claim 1, said apparatus further comprising a truncated cone-shaped element mounted inside of said housing with a tapering end disposed toward the downstream end of said housing, said truncated cone-shaped element having a porous wall adapted to allow exhaust gases to flow therethrough, and each of said sound absorbing layers being mounted radially outside of and so as to longitudinally overlap said truncated cone-shaped element.

6. The apparatus of claim 1, further comprising at least one spacer mounted within said housing so as to maintain the spacial relationship between said sound absorbing layers.

7. The apparatus of claim 1, said apparatus having a central longitudinal axis and being operatively adapted to allow exhaust gases to flow along its central longitudinal axis relatively unrestricted, from one end of said apparatus to the other, such as by not having to flow through a porous wall.

8. The apparatus of claim 1, said apparatus further comprising a truncated cone-shaped element mounted inside of said housing, said truncated cone-shaped element having a tapered end which is disposed downstream in said housing.

9. The apparatus of claim 1, further comprising a plurality of tubular sections mounted inside of said housing, each of said plurality of tubular sections having a porous wall operatively adapted for allowing exhaust gases to flow therethrough, and each of said tubular sections being lined by at least one of said sound absorbing layers.

10. A noise reduction apparatus for an internal combustion engine having an exhaust system, said apparatus comprising:

a housing operatively adapted for being mounted in the exhaust system of an internal combustion engine so that exhaust gases can pass through said apparatus, said housing having an upstream end through which exhaust gases enter said apparatus and a downstream end through which exhaust gases exit said apparatus;

a plurality of radially spaced tubular sections mounted inside of said housing, each of said plurality of tubular sections having a porous wall adapted to allow exhaust gases to flow therethrough; and a plurality of sound absorbing layers mounted inside of said housing in a radially spaced manner, each of said plurality of sound absorbing layers having an upstream end, being sufficiently porous to allow exhaust gases to flow therethrough, being operatively adapted to absorb acoustical energy from exhaust gases coming in contact therewith, and being supported by at least one of said tubular sections, wherein the upstream ends of said sound absorbing layers are longitudinally staggered relative to one another so as to generally define a truncated cone shape which tapers toward the downstream end of said housing.

11. The apparatus of claim 10, said apparatus further comprising a truncated cone-shaped element mounted inside of said housing so as to taper toward the downstream end of said housing, said truncated cone-shaped element having a porous wall adapted to allow exhaust gases to flow therethrough, and each of said tubular sections being mounted inside of said housing so as to be radially spaced outside of and so as to longitudinally overlap said truncated cone-shaped element.

12. The apparatus of claim 11, including at least a first, second and third tubular section, said third tubular section having a smaller diameter than and being mounted within said housing so as to be radially spaced concentrically within and overlapping said second tubular section, said second tubular section having a smaller diameter than and being mounted within said housing so as to be radially spaced concentrically within said first tubular section, and each said tubular section having a porous wall allowing exhaust gases to flow therethrough and being joined at one end to said truncated cone-shaped element, with said truncated cone-shaped element being mounted within said housing so as to be radially spaced within each said tubular section.

13. The apparatus of claim 11, each of said plurality of tubular sections having an upstream end joined to said truncated cone-shaped element.

14. The apparatus of claim 13, further comprising a bracket, each of said housing, said plurality of tubular sections and said truncated cone-shaped element having a downstream end maintained radially spaced apart by said bracket.

15. The apparatus of claim 10, each of said plurality of sound absorbing layers being made of an acoustical energy absorbing material in a form selected from the group consisting of acoustical energy absorbing particles, fiber, fabric and combinations thereof.

16. The apparatus of claim 10, said apparatus further comprising a truncated cone-shaped element having a tapered end, said truncated cone-shaped element being mounted inside said housing so that said tapered end is disposed downstream in said housing.

* * * * *